US007625299B2

(12) United States Patent
Fujimoto

(10) Patent No.: US 7,625,299 B2
(45) Date of Patent: Dec. 1, 2009

(54) GOLF PUTTER

(75) Inventor: Hiroaki Fujimoto, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 12/230,610

(22) Filed: Sep. 2, 2008

(65) Prior Publication Data

US 2009/0111605 A1 Apr. 30, 2009

(30) Foreign Application Priority Data

Oct. 29, 2007 (JP) ..... 2007-279752

(51) Int. Cl.
*A63B 53/04* (2006.01)

(52) U.S. Cl. ..... 473/340; 473/342; 473/349

(58) Field of Classification Search ..... 473/340, 473/342, 349
See application file for complete search history.

(56) References Cited

U.S. PATENT DOCUMENTS

| | | | | |
|---|---|---|---|---|
| 5,294,122 | A * | 3/1994 | Longo | 473/328 |
| 6,045,453 | A * | 4/2000 | Jenkins | 473/255 |
| 6,716,110 | B1 * | 4/2004 | Ballow | 473/242 |
| 7,371,187 | B2 * | 5/2008 | Moriyama et al. | 473/324 |
| 7,419,439 | B1 * | 9/2008 | Aleamoni | 473/251 |
| 2003/0036438 | A1 * | 2/2003 | Tang et al. | 473/242 |
| 2004/0127305 | A1 * | 7/2004 | Tang et al. | 473/242 |
| 2004/0173964 | A1 * | 9/2004 | Pollman | 273/252 |
| 2005/0227778 | A1 * | 10/2005 | Pollman | 473/252 |
| 2005/0239573 | A1 * | 10/2005 | Moriyama et al. | 473/340 |
| 2006/0019766 | A1 * | 1/2006 | Kubota | 473/340 |

(Continued)

FOREIGN PATENT DOCUMENTS

JP 2003-164551 A 6/2003

(Continued)

*Primary Examiner*—Stephen L. Blau
(74) *Attorney, Agent, or Firm*—Birch, Stewart, Kolasch & Birch, LLP

(57) ABSTRACT

A real loft angle of a putter (2) is one to four degrees. In a reference section (D1), an intersection point of a line which passes through a center of gravity (g1) of a head and is perpendicular to a horizontal plane (H1) and a sole surface (18) is represented by (T1), a line passing through the point (T1) and a leading edge point (Le) is represented by (S1), a point which is present on the sole surface (18) and is provided apart from the line (S1) toward a lowermost side is represented by (T2), a line which passes through the point (T2) and is parallel with the line (S1) is represented by (S2), a distance between the point (T2) and the line (S1) is represented by (K1), a line passing through the point (T2) and the point (Le) is represented by (S3), a distance in the front-rear direction between the point (T2) and the point (Le) is represented by (L), and a distance in the front-rear direction between the point (T1) and the point (Le) is represented by (M). An angle (θ1) formed by the line (S3) and the horizontal plane (H1) is equal to or greater than two degrees and is equal to or smaller than ten degrees. (K1/M) is greater than zero and is equal to or smaller than 0.10. (L/P) is equal to or greater than 0.10 and is equal to or smaller than 0.50. A lower portion (22) positioned below the line (S1) is present between the point (T1) and the point (Le).

4 Claims, 6 Drawing Sheets

U.S. PATENT DOCUMENTS

| | | | | |
|---|---|---|---|---|
| 2006/0142095 | A1* | 6/2006 | Glickman | 473/340 |
| 2007/0191137 | A1* | 8/2007 | Nishino | 473/340 |
| 2007/0243951 | A1* | 10/2007 | Nishino | 473/340 |
| 2007/0259734 | A1* | 11/2007 | Pollman | 473/313 |
| 2008/0293513 | A1* | 11/2008 | Bitko et al. | 473/340 |

FOREIGN PATENT DOCUMENTS

| | | | |
|---|---|---|---|
| JP | 2003-275349 | A | 9/2003 |
| JP | 2003-275351 | A | 9/2003 |
| JP | 2003-275352 | A | 9/2003 |
| JP | 2003-275353 | A | 9/2003 |

* cited by examiner

GOLF PUTTER

This application claims priority on Patent Application No. 2007-279752 filed in JAPAN on Oct. 29, 2007, the entire contents of which are hereby incorporated by reference.

BACKGROUND OF THE INVENTION

1. Field of the Invention

The present invention relates to a golf putter.

2. Description of the Related Art

A fine sense of distance and an accurate hitting directivity are required for putting. Different functions from those of other golf clubs are demanded for a golf putter.

In respect of the hitting directivity, there has been known a head having a great length in a front-rear direction (face-back direction) thereof and a high moment of inertia.

In respect of the sense of distance, moreover, there has been demanded a putter capable of rolling a ball smoothly and easily. Japanese Laid-Open Patent Publication No.2003-164551, Japanese Laid-Open Patent Publication No. 2003-275349, Japanese Laid-Open Patent Publication No. 2003-275351, Japanese Laid-Open Patent Publication No. 2003-275352, and Japanese Laid-Open Patent Publication No. 2003-275353 have disclosed the invention of a golf putter which has an object to give an overspin rotation to a ball.

SUMMARY OF THE INVENTION

A head for a putter club usually has a positive real loft angle in the same manner as a wood type golf club head or an iron type golf club head. In the case in which the real loft angle is zero degree or negative, there is easily generated a situation in which a ball is pushed against a ground in a moment of hitting. In this situation, there is easily generated a phenomenon in which the ball bounds due to a reaction caused by the push of the ball against the ground. By the phenomenon, a rolling distance of the ball is apt to be varied and a directivity (a degree of shift) is also deteriorated. A positive real loft angle can suppress the phenomenon.

A putting stroke is carried out by a golf player (a person). For this reason, a loft angle in an impact is varied every stroke. Furthermore, a posture of a putter club in the impact is varied for every golf player. Also in some cases in which the real loft angle is zero degree, accordingly, the loft angle in the impact is negative. The loft angle in the impact is defined as an angle of the face surface with respect to a vertical direction in a moment of the impact.

On the other hand, in the case in which a positive real loft angle is provided, a backspin is easily generated on the hit ball. A rotating direction of the backspin is reverse to a rotating direction in the case in which the ball rolls. Accordingly, there is generated a phenomenon in which the hit ball slides over a lawn surface (a green surface) in an initial stage of the roll through the backspin. Due to the slide, it is hard to control a rolling distance so that the rolling distance is apt to be varied.

It is an object of the present invention to provide a golf putter capable of obtaining a stable roll.

A golf putter according to the present invention includes a head, a shaft and a grip. A real loft angle of the golf putter is equal to or greater than one degree and is equal to or smaller than four degrees. A length P (mm) in a front-rear direction of the head is equal to or greater than 30 mm and is equal to or smaller than 100 mm. A state in which the head is stationarily mounted by itself on a horizontal plane H1 is set to be a reference state, a plane which passes through a center of gravity of the head, is perpendicular to the horizontal plane H1 and includes a line in a front-rear direction is set to be a reference plane in the head brought into the reference state, and a section of the head in the reference state along the reference plane is set to be a reference section, and when an intersection point of a line which passes through the center of gravity of the head and is perpendicular to the horizontal plane H1 and a sole surface is represented by T1, a line passing through the point T1 and a leading edge point is represented by S1, a point which is present on the sole surface and is provided apart from the line S1 toward a lowermost side is represented by T2, a line which passes through the point T2 and is parallel with the line S1 is represented by S2, a distance between the point T2 and the line S1 is represented by K1 (mm), a line passing through the point T2 and the leading edge point is represented by S3, a distance in a front-rear direction between the point T2 and the leading edge point is represented by L (mm), and a distance in a front-rear direction between the point T1 and the leading edge point is represented by M (mm) in the reference section, an angle θ1 formed by the line S3 and the horizontal plane H1 is equal to or greater than two degrees and is equal to or smaller than ten degrees, (K1/M) is greater than zero and is equal to or smaller than 0.10, (L/P) is equal to or greater than 0.10 and is equal to or smaller than 0.50, and a lower portion is positioned below the line S1 between the point T1 and the leading edge point.

It is preferable that a height N of the center of gravity of the head should be equal to or greater than 20 mm.

It is preferable that the sole surface should have a plane portion including the point T1. It is preferable that (Q/P) should be equal to or greater than 0.1 when a rearmost point of the plane portion is represented by T3 and a distance in a front-rear direction between the point T1 and the point T3 is presented by Q (mm) in the reference section.

The golf putter according to the present invention can suppress a backspin in an initial stage of a roll with a positive real loft angle.

DESCRIPTION OF THE PREFERRED EMBODIMENTS

The present invention will be described below in detail based on a preferred embodiment with reference to the drawings. A toe-heel direction, a front-rear direction and a up-down direction are defined as follows.

A state in which a head is stationarily mounted by itself on a horizontal plane H1 is set to be a reference state. Referring to the head in the reference state, a direction which is parallel with a face surface and is parallel with the horizontal plane H1 can be set to be the toe-heel direction. Referring to the head in the reference state, a direction which is parallel with the horizontal plane H1 and is perpendicular to the toe-heel direction can be set to be the front-rear direction. Furthermore, a direction which is perpendicular to the toe-heel direction and is perpendicular to the front-rear direction can be set to be the up-down direction.

Figure 1:
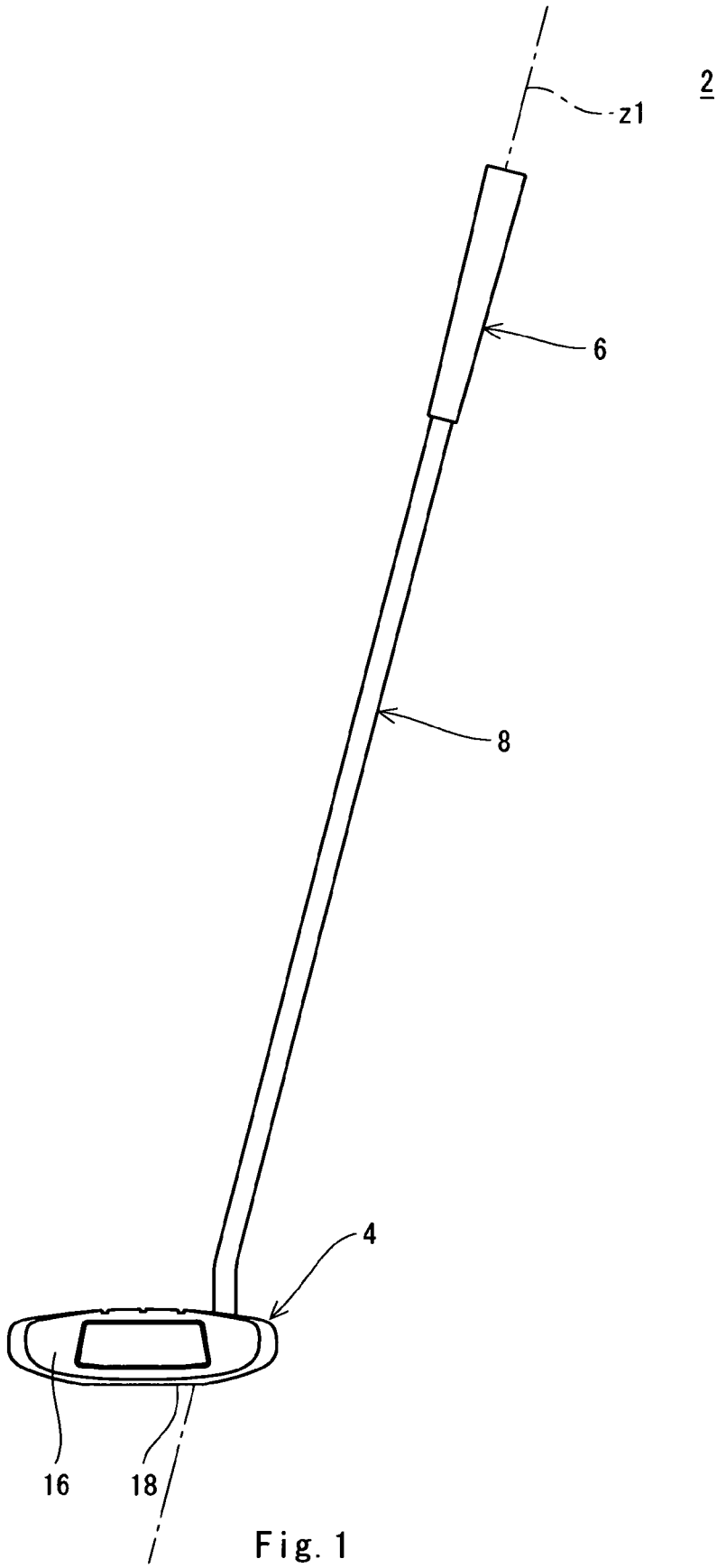
FIG. 1 is a general view showing a golf putter according to an embodiment of the present invention.

FIG. 1 is a general view showing a golf putter 2 according to an embodiment of the present invention. The golf putter 2 has a head 4, a grip 6 and a shaft 8. The head 4 is attached to one of ends of the shaft 8. The grip 6 is attached to the other end of the shaft 8. A close portion to the end of the shaft 8 is bent in such a manner that a lie angle and a real loft angle of the golf putter 2 are proper.

Figure 2:
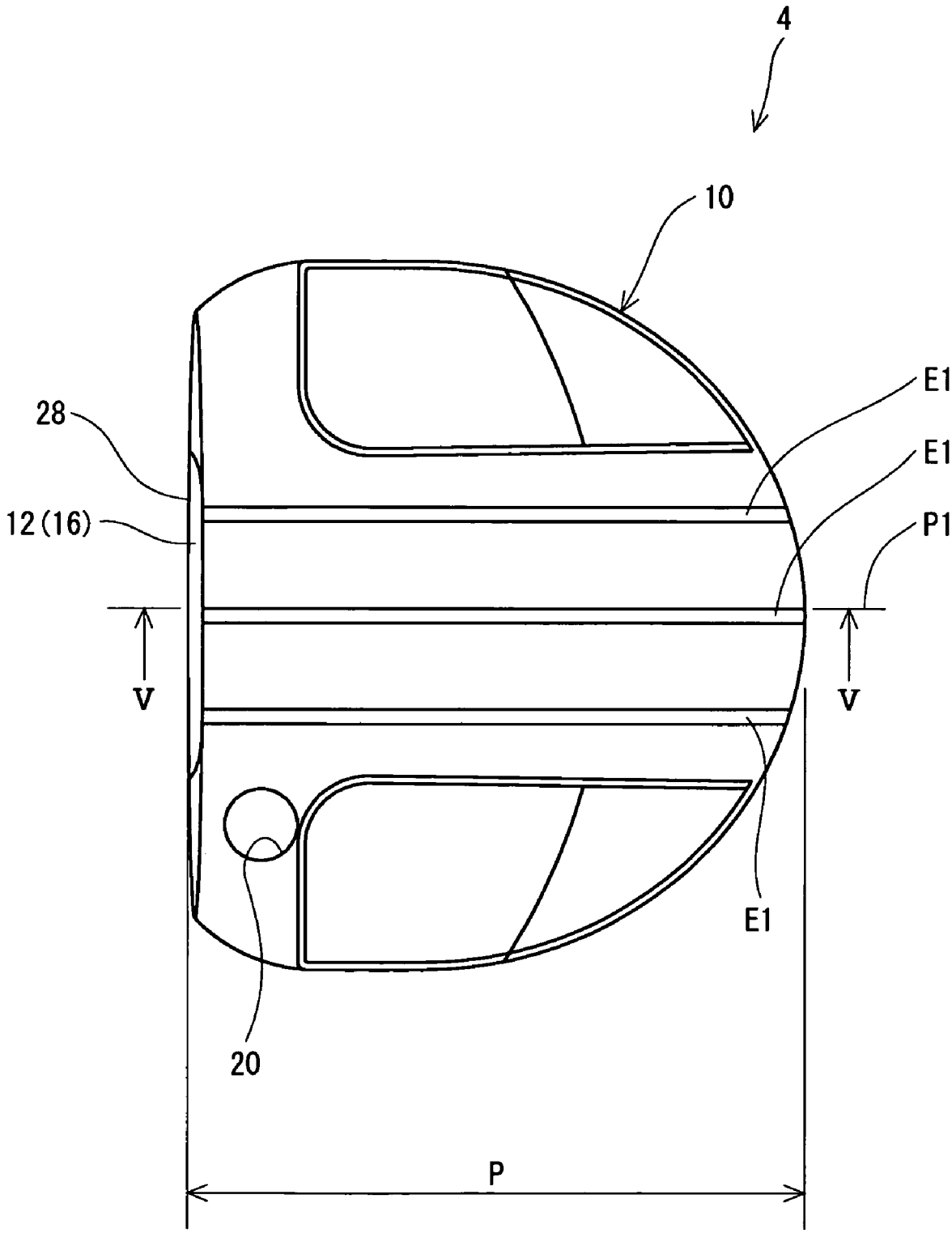
FIG. 2 is a view showing a head attached to the golf putter of FIG. 1 as seen from above.
Figure 3:
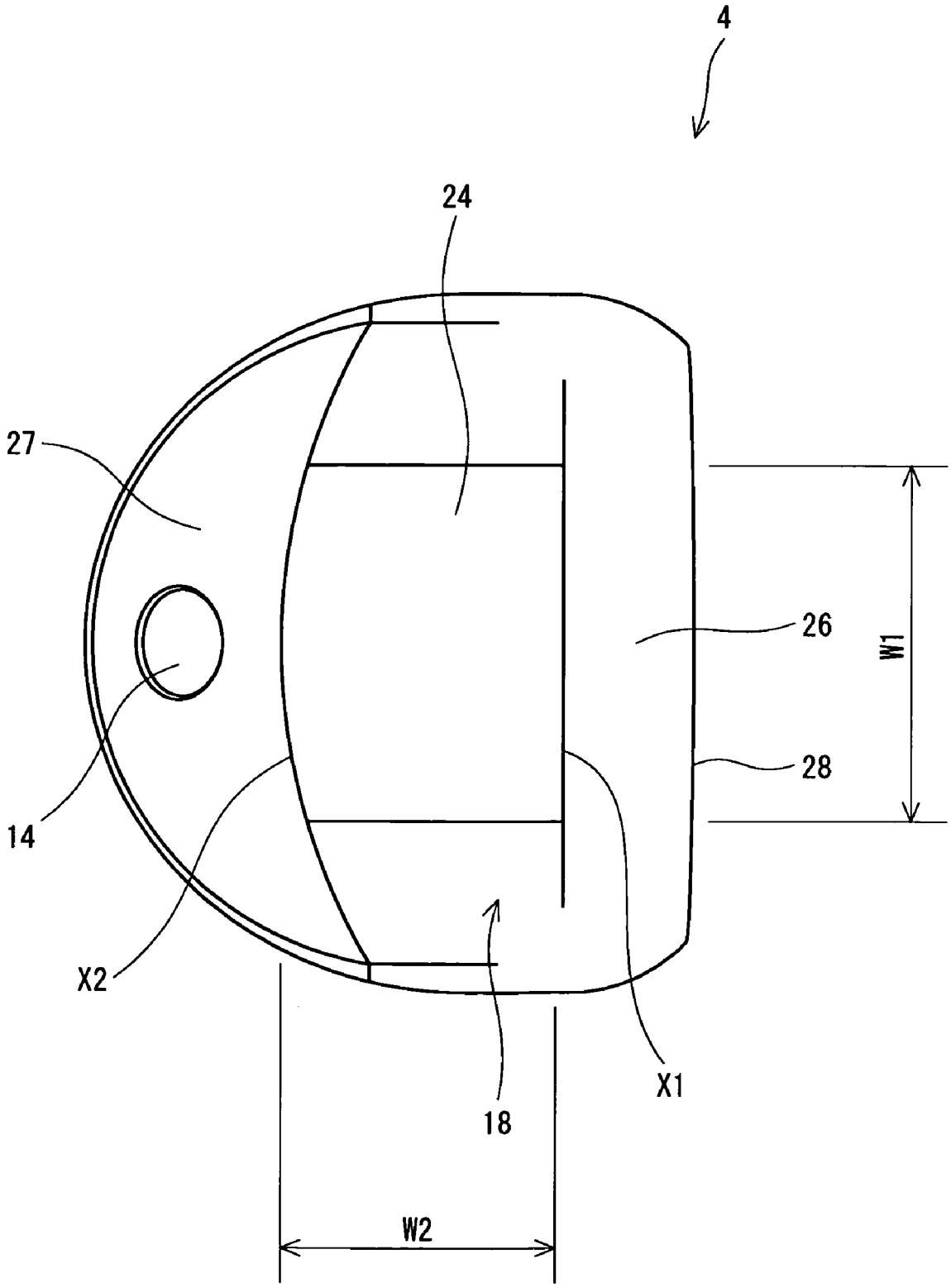
FIG. 3 is a view showing the head of FIG. 2 as seen from below.
Figure 4:
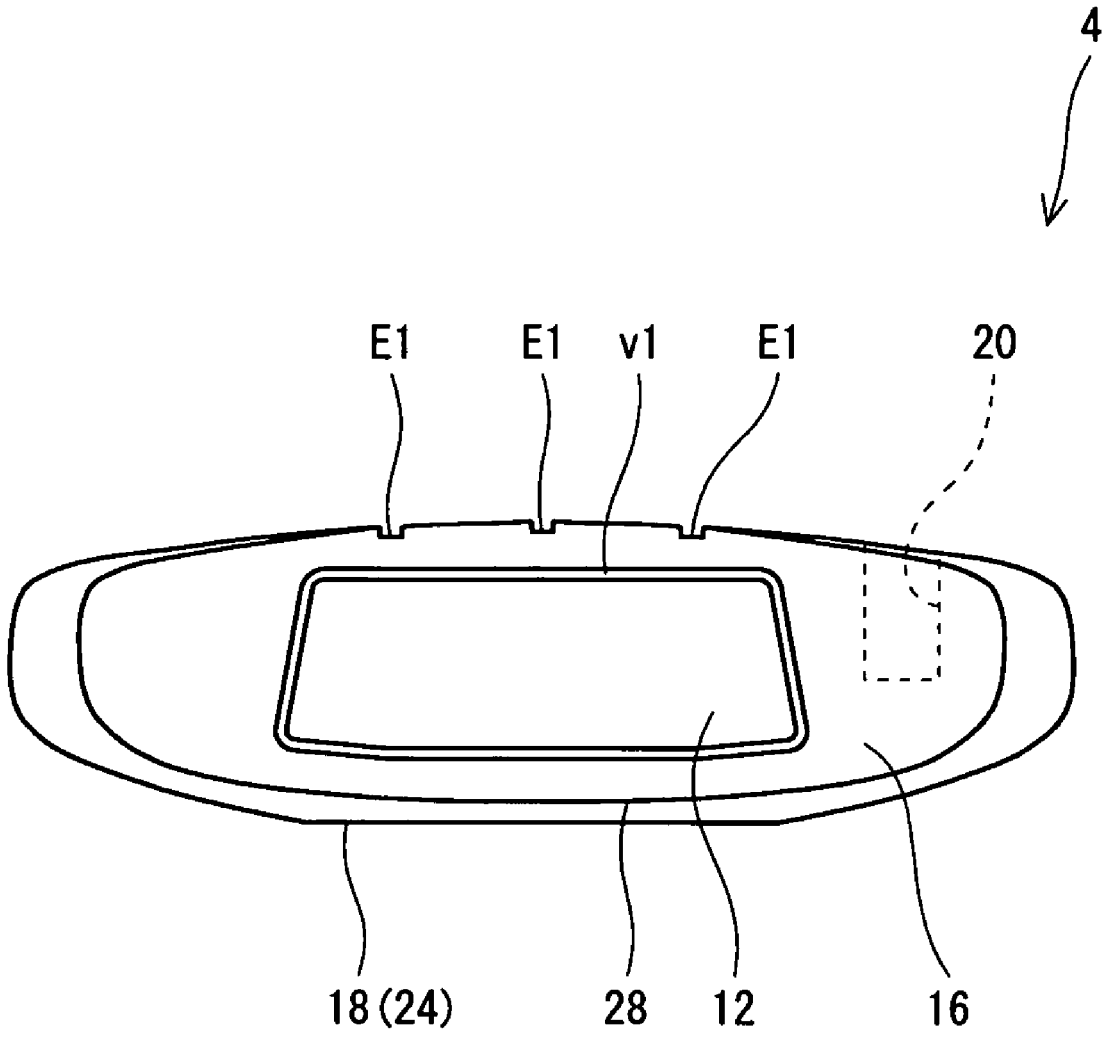
FIG. 4 is a view showing the head of FIG. 2 as seen from a face side.
Figure 5:
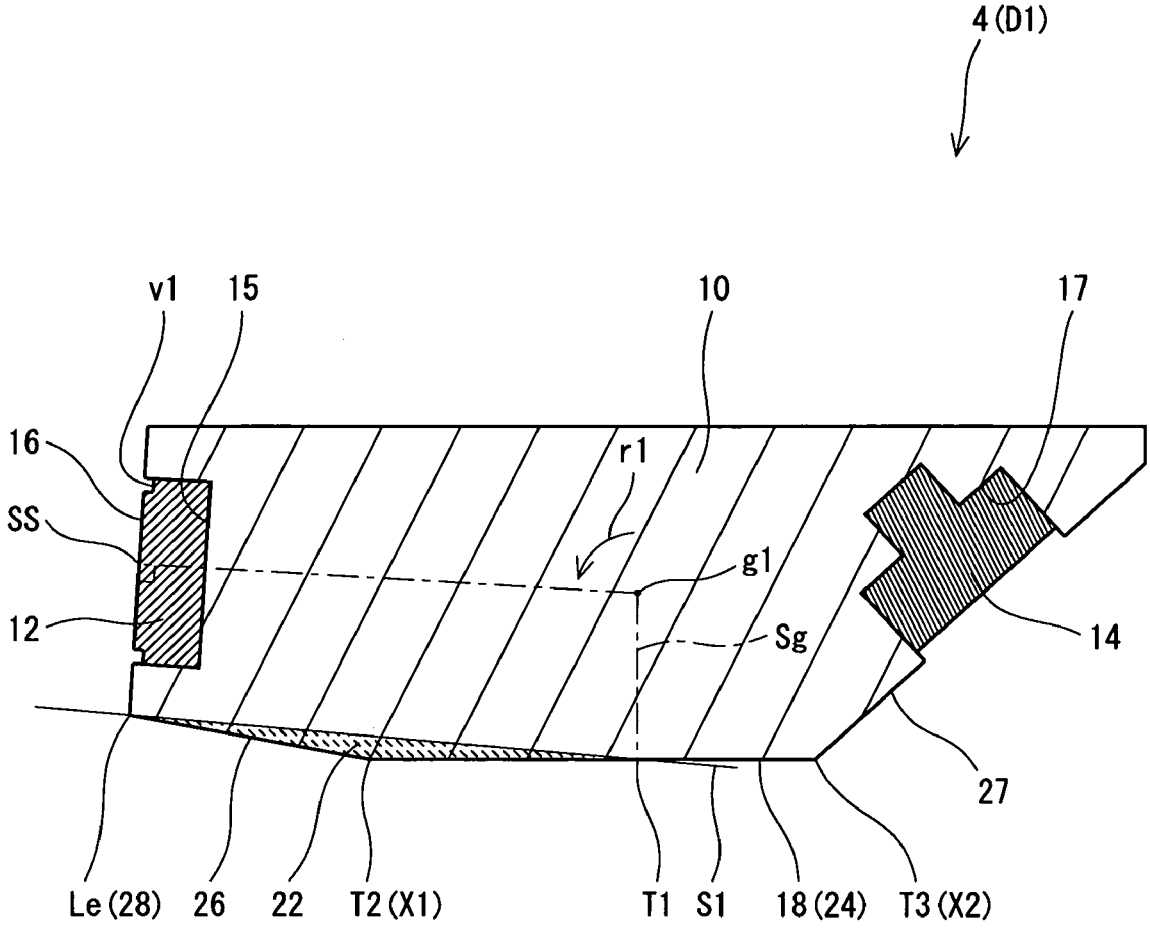
FIG. 5 is a view showing a reference section of the head in FIG. 2.
Figure 6:
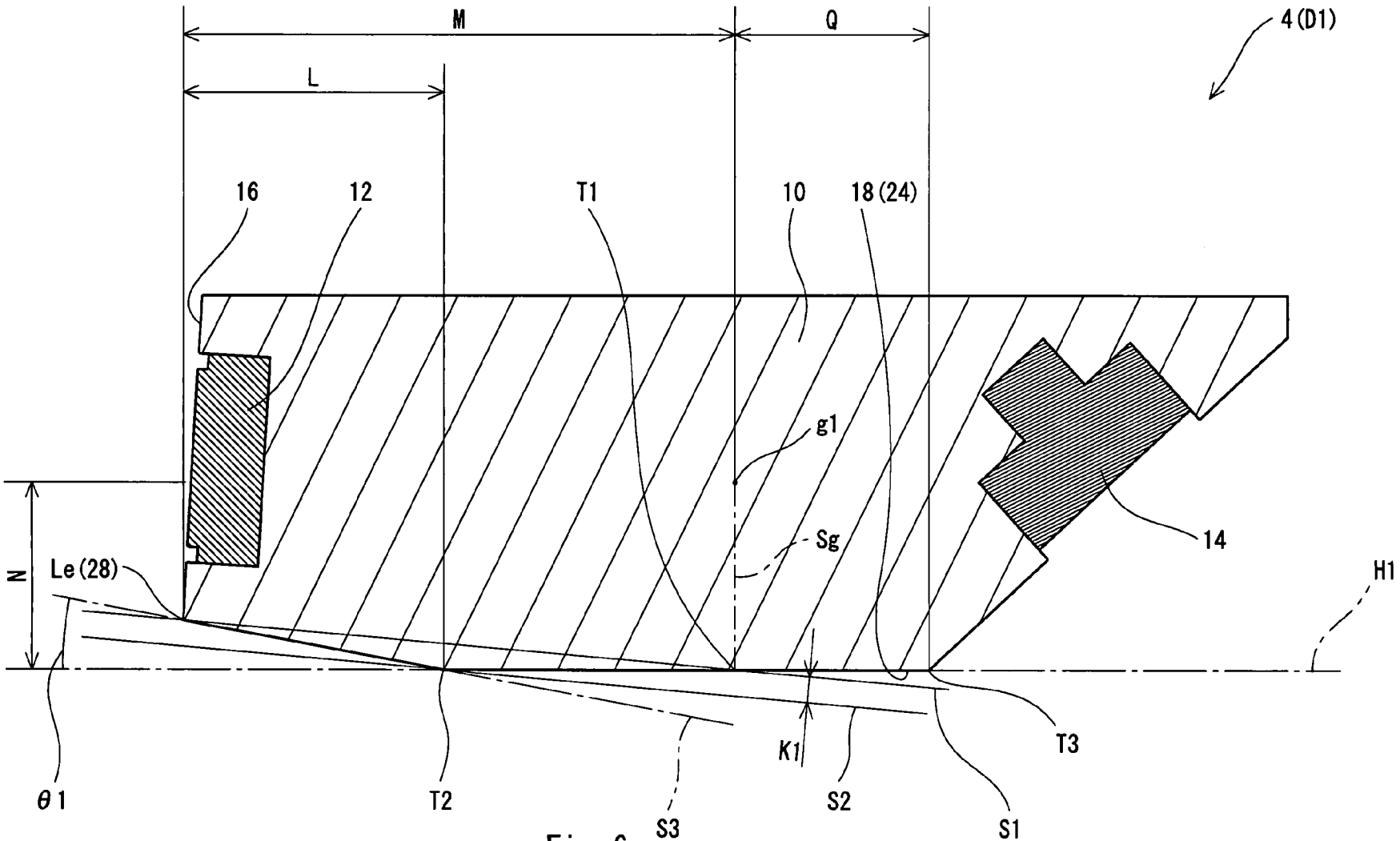
FIG. 6 is an enlarged view of FIG. 5.

FIG. 2 is a view showing the head 4 for the golf putter according to the embodiment of the present invention as seen from an upper side (a top side). FIG. 3 is a view showing the head 4 seen from below (a sole side). FIG. 4 is a front view showing the head 4 seen from a face side. FIG. 5 is a sectional view taken along a V-V line of FIG. 2. FIG. 6 is an enlarged view of FIG. 5.

The head 4 includes a head body 10, a face insert 12 and a rear member 14. The face insert 12 is accommodated in a recess portion 15 provided on a front surface of the head body 10. The rear member 14 is accommodated in a recess portion 17 provided in a rear part of the head body 10.

The head 4 has a face surface 16 and a sole surface 18. As shown in FIG. 4, a central part of the face surface 16 is constituted by the face insert 12. The sole surface 18 is constituted by the head body 10 and the rear member 14. A peripheral edge part of the face surface 16 is constituted by the head body 10. The face surface 16 is a plane except for a groove v1 which is present on a boundary between the face insert 12 and the head body 10. The "face surface" in the definition of the toe-heel direction is regarded as a plane in which the groove v1 is filled up.

Examples of a material of the head body 10 include a metal, a resin, FRP (fiber reinforced plastic) and the like. Examples of the metal include steel (soft iron), stainless steel, an aluminum alloy and a titanium alloy.

Examples of a material of the face insert 12 include a metal, a resin, FRP (fiber reinforced plastic) and the like. Examples of the metal include stainless steel, an aluminum alloy, a titanium alloy, a tungsten alloy and the like. A urethane resin can be taken as an example of the resin. The urethane resin includes an elastomer having a hard segment and a soft segment. The material of the face insert 12 is different from that of the head body 10. A specific gravity of the face insert 12 is smaller than that of the head body 10. The face insert 12 contributes to an enhancement in a degree of freedom of a design in the head 4. The face insert 12 contributes to an enhancement in a feeling of hitting.

Examples of a material of the rear member 14 include a metal, a resin, FRP (fiber reinforced plastic) and the like. Examples of the metal include stainless steel, copper, brass, a tungsten nickel alloy, a tungsten alloy and the like. The material of the rear member 14 is different from that of the head body 10. A specific gravity of the rear member 14 is greater than that of the head body 10. The rear member 14 contributes to an enhancement in a degree of freedom of a design in the head 4. The rear member 14 contributes to an enhancement in a moment of inertia.

A visible line E1 seen in parallel with the front-rear direction from above is provided on an upper surface of the head 4. A golf player tends to turn the face surface 16 in a target direction in addressing through the visible line E1.

As shown in FIG. 2, the head 4 has a shaft hole 20. In the golf putter 2, a tip portion of the shaft 8 is inserted into the shaft hole 20. The tip portion of the shaft 8 is bonded to an internal surface of the shaft hole 20.

In the present invention, a reference plane and a reference section are defined. In the head brought into the reference state, a plane to satisfy the following (1a), (1b) and (1c) is defined as a reference plane P1:

(1a) Pass through a centre of gravity g1 of the head;

(1b) Perpendicular to the horizontal plane H1; and (1c) Include a line in the front-rear direction (a line extended in the front-rear direction).

A head section taken along the reference plane P1 represents a reference section D1. The reference section D1 indicates a section of the head brought into the reference state. FIGS. 5 and 6 are views showing the reference section D1.

In the reference section D1 of the head 4, a line Sg, a point T1, a line S1, a leading edge point Le, a point T2, a line S2, a distance K1 (mm), a line S3, a distance L (mm), a distance M (mm) and an angle θ1 are defined.

The line Sg passes through the center of gravity g1 of the head and is perpendicular to the horizontal plane H1 (see FIG. 6).

The point T1 is an intersection point of the line Sg and the sole surface 18.

The line S1 passes through the point T1 and the leading edge point Le.

The leading edge point Le is positioned on a most forward side in the reference section D1.

The point T2 is present on the sole surface 18 and is provided apart from the line S1 toward a most downward side.

The line S2 passes through the point T2 and is parallel with the line S1.

The distance K1 (mm) is a distance (the shortest distance) between the point T2 and the line S1.

The line S3 passes through the point T2 and the leading edge point Le.

The distance L (mm) is a distance in the front-rear direction between the point T2 and the leading edge point Le.

The distance M (mm) is a distance in the front-rear direction between the point T1 and the leading edge point Le.

The angle θ1 is formed by the line S3 and the horizontal plane H1.

In the reference section D1 of the head 4, a lower portion 22 is positioned below the line S1 between the point T1 and the leading edge point Le (see FIG. 5). In FIG. 5, the lower portion 22 is shown in hatching.

As shown in FIG. 3, the sole surface 18 has a plane portion 24 including the point T1. Furthermore, the sole surface 18 has a forward inclined surface 26 positioned ahead of the plane portion 24. In all positions in the toe-heel direction, the forward inclined surface 26 is present ahead of the plane portion 24. The forward inclined surface 26 is formed between a leading edge 28 and the plane portion 24. The forward inclined surface 26 is inclined upward in a forward direction. The forward inclined surface 26 is a plane. The forward inclined surface 26 may be a curved surface. A front end of the forward inclined surface 26 forms the leading edge 28. A rear end of the forward inclined surface 26 serves as a front end of the plane portion 24.

In all sections which are parallel with the reference section D1, an angle θa (not shown) formed by the plane portion 24 and the forward inclined surface 26 can be determined. The angle θa is determined in each position in the toe-heel direction. An absolute value of a difference between a maximum value of the angle θa and a minimum value of the angle θa is equal to or greater than zero degree and is equal to or smaller than 10 degrees.

A boundary line X1 between the plane portion 24 and the forward inclined surface 26 includes the point T2 which will be described below.

In the reference state, the plane portion 24 is provided in face contact with the horizontal plane H1. In the reference state, the plane portion 24 constitutes the lowest part of the head 4. In the head 4 brought into the reference state, portions other than the plane portion 24 are positioned above the plane portion 24. By the presence of the plane portion 24, the head 4 can be stably mounted on a ground. In other words, the presence of the plane portion 24 causes the head 4 to be stabilized in the addressing. The golf putter 2 can easily be addressed by the plane portion 24.

As shown in FIG. 3, the sole surface 18 has a rearward inclined surface 27. The rearward inclined surface 27 is inclined upward in a rearward direction of the head 4. The rearward inclined surface 27 is present behind the plane portion 24 in all positions in the toe-heel direction. The rearward inclined surface 27 is a plane. The rearward inclined surface 27 may be a curved surface. A boundary line X2 between the plane portion 24 and the rearward inclined surface 27 includes a point T3 which will be described below.

In all sections which are parallel with the reference section D1, an angle θb (not shown) formed by the plane portion 24 and the rearward inclined surface 27 can be determined. The angle θb is determined in each position in the toe-heel direction. An absolute value of a difference between a maximum value of the angle θb and a minimum value of the angle θb is equal to or greater than zero degree and is equal to or smaller than 10 degrees.

In the reference section D1 according to the present embodiment, the point T2 is positioned on the front end of the plane portion 24. The point T2 does not need to be positioned on the front end of the plane portion 24. In the reference section D1 according to the present embodiment, the point T2 is positioned on the rear end of the forward inclined surface 26. The point T2 does not need to be positioned on the rear end of the forward inclined surface 26. In the reference section D1 according to the present embodiment, the point T2 is positioned on a boundary between the plane portion 24 and the forward inclined surface 26. The point T2 does not need to be positioned on a boundary between the plane portion 24 and the forward inclined surface 26.

The leading edge 28 is defined as a set of points placed in the most forward position in a head section Dn. The head section Dn is parallel with the reference section D1. The head section Dn is determined in all positions in the toe-heel direction. The head section Dn indicates a section of the head 4 in the reference state. Examples of the head section Dn include the reference section D1. The leading edge 28 constitutes an edge line. The leading edge 28 constitutes a lower edge of the face surface 16. The leading edge 28 includes the leading edge point Le.

In the reference section D1 of the head 4, the point T3 and a distance Q are defined.

The point T3 is a rearmost point of the plane portion 24 (see FIG. 6).

The distance Q (mm) is a distance in the front-rear direction between the points T1 and T3 (see FIG. 6).

In the case in which a real loft angle is small, a ball is pushed against the ground in hitting so that the ball tends to bound. Due to the push or bound, a rolling distance is apt to be varied. In order to control the variation in the rolling distance, the real loft angle of the golf putter 2 is preferably equal to or greater than one degree and is more preferably equal to or greater than two degrees. In order to suppress a backspin, the real loft angle of the golf putter 2 is preferably equal to or smaller than four degrees and is more preferably equal to or smaller than three degrees.

The real loft angle is defined with respect to a shaft axis z1 (see FIG. 1). The shaft axis z1 is placed in a portion on the grip 6 side from a bent part which is close to one of ends of the shaft 8. The shaft axis z1 is placed in a portion of the shaft 8 to which the grip 6 is attached.

A double arrow P in FIG. 2 indicates a length P (mm) in the front-rear direction of the head 4. In respect of an increase in a moment of inertia, the length P (mm) in the front-rear direction is preferably equal to or greater than 30 mm, is more preferably equal to or greater than 50 mm, and is further preferably equal to or greater than 60 mm. In some cases in which the length P (mm) in the front-rear direction is excessively great, a weight of the head 4 is excessively increased or a stroke is smoothly carried out with difficulty. From this viewpoint, the length P (mm) in the front-rear direction is preferably equal to or smaller than 100 mm, is more preferably equal to or smaller than 90 mm and is further preferably equal to or smaller than 80 mm.

In the hitting, the head 4 collides with the ball. By the collision, a rotation moment around the center of gravity g1 of the head 4 can be applied to the head 4. By the collision, the head 4 can be rotated.

In the hitting, the head 4 is rotated in a direction of an arrow r1 of FIG. 5 around the center of gravity g1 of the head 4 in some cases, for example. As a result of the rotation, an effective loft angle of the head 4 is reduced. The effective loft angle is formed when the ball and the head 4 come in contact with each other. The effective loft angle is defined as an angle with respect to the vertical direction. The effective loft angle can be changed depending on a posture of the head 4. The effective loft angle is also referred to as an impact loft angle in some cases. The rotation of the head 4 to reduce the effective loft angle is generated when the ball hits on a lower side of a sweet spot SS (see FIG. 5).

In the impact, the ball and the face surface 16 continuously come in contact with each other for some duration. More specifically, in the impact, a contact time of the ball and the face surface 16 is present. From a start of the contact time to an end thereof, the golf player continuously applies a force for forward pressing the head 4 to the head 4 through the grip 6 and the shaft 8. By the forward pressing force, the head 4 is rotated in such a direction as to reduce the effective loft angle.

In the case in which the angle θ1 is small, a forward part of the head 4 is lowered so that a forward part of the sole surface 18 is apt to collide with the ground when the head 4 is rotated in such a direction as to reduce the effective loft angle. In the case in which the angle θ1 is small, the forward part of the sole surface 18 is apt to collide with the ground so that the effective loft angle is reduced with difficulty. When the angle θ1 is increased, the rotation of the head 4 for reducing the effective loft angle tends to be generated. In other words, when the angle θ1 is increased, the effective loft angle tends to be reduced. When the effective loft angle is reduced, a backspin rate is controlled. From this viewpoint, the angle θ1 is preferably equal to or greater than two degrees, is more preferably equal to or greater than three degrees, and is further preferably equal to or greater than four degrees. In the case in which the angle θ1 is excessively increased, an area of the face surface 16 tends to be reduced. In the case in which the area of the face surface 16 is large, a missed hit tends to be decreased. In order to increase the area of the face surface 16, the angle θ1 is preferably equal to or smaller than ten degrees, is more preferably equal to or smaller than eight degrees, and is further preferably equal to or smaller than six degrees.

The lower portion 22 can control the rotation of the head 4 in such a manner that the effective loft angle is excessively reduced. In the case in which the lower portion 22 is not present, the head 4 is excessively rotated so that the effective loft angle is apt to be excessively reduced. In the case in which the effective loft angle is excessively small, the ball is pushed against the ground so that the bound of the ball or the like tends to be generated. From this viewpoint, it is preferable that the lower portion 22 should be present. The angle θ1 is set to be equal to or greater than two degrees and the lower portion 22 is present so that the effective loft angle tends to be appropriate. The appropriately effective loft angle controls the backspin rate. At the same time, the appropriately effective loft angle suppresses a phenomenon in which the ball is pushed against the ground. By the appropriately effective loft angle, a rolling distance tends to be stabilized. By the appropriately effective loft angle, a hitting directivity tends to be stabilized.

In the case in which (K1/M) is great, the head 4 tends to be stabilized in the addressing. If (K1/M) is great, moreover, the posture of the head 4 immediately before the impact tends to be stabilized. From these viewpoints, (K1/M) is preferably greater than zero and is more preferably equal to or greater than 0.01. When (K1/M) is reduced, the rotation of the head 4 to reduce the effective loft angle tends to be generated. In order to cause the effective loft angle to be appropriate through the rotation of the head 4 to reduce the effective loft angle, (K1/M) is preferably equal to or smaller than 0.10, is more preferably equal to or smaller than 0.07 and is further preferably equal to or smaller than 0.05.

If (L/P) is great, the forward part of the sole surface 18 is hard to collide with the ground in the rotation of the head 4 to reduce the effective loft angle. In order to cause the effective loft angle to be appropriate through the rotation of the head 4 to reduce the effective loft angle, (L/P) is preferably equal to or greater than 0.10, is more preferably equal to or greater than 0.13, and is further preferably equal to or greater than 0.25. If (L/P) is small, the head 4 tends to be stabilized in the addressing. If (L/P) is small, the posture of the head 4 immediately before the impact tends to be stabilized. From these viewpoints, (L/P) is preferably equal to or smaller than 0.50, is more preferably equal to or smaller than 0.44 and is further preferably equal to or smaller than 0.38.

A double arrow N in FIG. 6 indicates a height of the center of gravity g1 of the head 4. The height N is measured in the head 4 brought into the reference state. The height N indicates a distance between the horizontal plane H1 and the center of gravity g1 of the head 4 (the shortest distance). In the case in which the height N is great, the height of the sweet spot SS also tends to be increased. In the case in which the height N is great, the ball tends to collide with a lower side of the sweet spot SS. In the case in which the height N is great, accordingly, the head 4 tends to be rotated to reduce the effective loft angle. In order to cause the effective loft angle to be appropriate through the rotation of the head 4 to reduce the effective loft angle, the height N is preferably equal to or greater than 20 mm, is more preferably equal to or greater than 21 mm and is further preferably equal to or greater than 22 mm. In some cases in which the height N is set to be greater, a weight of the head 4 is excessively increased. In the case in which the weight of the head 4 is excessively great, a control performance of the rolling distance is apt to be deteriorated. From this viewpoint, the height N is preferably equal to or smaller than 25 mm and is more preferably equal to or smaller than 24 mm.

In the case in which (Q/P) is excessively small, an inclination of the head 4 during a stroke tends to be varied immediately before hitting. In the case in which (Q/P) is excessively small, moreover, the head 4 during the stroke tends to be rotated immediately before the hitting. A rotating axis of the rotation is set in the up-down direction passing through the center of gravity g1 of the head 4, for example. In the case in which (Q/P) is excessively small, furthermore, a stability of the head 4 in the addressing is apt to be deteriorated. In the case in which (Q/P) is excessively small, thus, the posture of the head 4 is hard to stabilize and the hitting directivity is apt to be deteriorated. From this viewpoint, (Q/P) is preferably equal to or greater than 0.10, is more preferably equal to or greater than 0.13, and is further preferably equal to or greater than 0.25. In some cases in which (Q/P) is excessively great, the weight of the head 4 is excessively increased. In the case in which the weight of the head 4 is excessively great, the control performance of the rolling distance is apt to be deteriorated. From this viewpoint, (Q/P) is preferably equal to or smaller than 0.56, is more preferably equal to or smaller than 0.50 and is further preferably equal to or smaller than 0.38.

In the case in which the real loft angle is positive, the height of the sweet spot SS is greater than the height N of the center of gravity g1 of the head 4. The reason is that the sweet spot SS is an intersection point of a vertical line drawn from the center of gravity g1 of the head 4 to the face surface 16 and the face surface 16 as shown in FIG. 5. On a condition that the height N is constant, the height of the sweet spot SS is made greater when the distance M in the front-rear direction is increased. From this viewpoint, the distance M in the front-rear direction is preferably equal to or greater than 20 mm, is more preferably equal to or greater than 25 mm and is further preferably equal to or greater than 30 mm. In some cases in which the distance M in the front-rear direction is excessively great, a distribution of the weight of the head 4 excessively concentrates in a rear part of the head 4 so that the moment of inertia is reduced. In some cases in which the distance M in the front-rear direction is excessively great, moreover, the weight of the head 4 is excessively increased. From these viewpoints, the distance M in the front-rear direction is preferably equal to or smaller than 50 mm and is more preferably equal to or smaller than 40 mm.

A double arrow W1 in FIG. 3 indicates a width in the toe-heel direction of the plane portion 24. In respect of the stability of the head 4 in the addressing, the width W1 is preferably equal to or greater than 15 mm, is more preferably equal to or greater than 20 mm, is more preferably equal to or greater than 30 mm, and is further preferably equal to or greater than 40 mm. In the case in which the plane portion 24 is excessively large, the sole surface 18 tends to come in contact with the ground during the stroke. From this viewpoint, the width W1 is preferably equal to or smaller than 80 mm, is more preferably equal to or smaller than 70 mm, and is further preferably equal to or smaller than 60 mm. The width W1 is determined in each position in the toe-heel direction.

A double arrow W2 in FIG. 3 indicates a width in the front-rear direction of the plane portion 24. In order to cause (Q/P) to have a preferable value and to obtain the stability of the head 4 in the addressing, the width W2 is preferably equal to or greater than 15 mm, is more preferably equal to or greater than 20 mm, is more preferably equal to or greater than 30 mm, and is further preferably equal to or greater than 40 mm. In the case in which the plane portion 24 is excessively large, the sole surface 18 tends to come in contact with the ground during the stroke. In order to control the contact and to cause (Q/P) to have the preferable value, the width W2 is preferably equal to or smaller than 70 mm, is more preferably equal to or smaller than 60 mm, and is further preferably equal to or smaller than 50 mm. The width W2 is determined in each position in the toe-heel direction.

A maximum width in the toe-heel direction of the forward inclined surface 26 is set to be equal to or greater than a maximum value of the width W1. The effect of the present invention is further increased by the forward inclined surface 26 which is large in the toe-heel direction. A maximum width in the toe-heel direction of the rearward inclined surface 27 is set to be equal to or greater than the maximum value of the width W1. The effect of the present invention is further increased by the rearward inclined surface 27 which is large in the toe-heel direction.

In the head 4 brought into the reference state, it is preferable that a plane Hp having a difference in a height of 2 mm or less in the up-down direction from the point T1 should be provided behind the point T1. By the plane Hp, a stability in the addressing and a stability of a swing including an impact tend to be maintained. In the embodiment described above, a part of the plane portion 24 acts as the plane Hp.

As a general technical standard of the skilled in the art, a "gear effect" has been known. The gear effect is obtained when the head rotated through a collision with the ball is to apply, to the ball, a rotation in a reverse direction to a rotating direction of the head. For the gear effect, there have been known a gear effect related to a sidespin rate and a gear effect related to a backspin rate. The gear effect related to the backspin rate is referred to as a longitudinal gear effect or a gear effect in the vertical direction in some cases.

If the gear effect acts, the rotation of the head to reduce the effective loft angle increases the backspin rate of the ball. As described above, the rolling distance tends to be varied with the increase in the backspin rate. In the present invention, however, it was found that the head which tends to generate the rotation to reduce the effective loft angle can suppress a variation in the rolling distance. As described above, in the present invention, the effective loft angle decreased as a result of the rotation of the head can suppress the backspin rate. The result can be supposed to imply that the effect of controlling the backspin rate is greater than the effect of increasing the backspin rate which is derived from the gear effect.

Although the details of the reason why the result is generated are not apparent, the following can be considered. Referring to a shot (putting) made by a putter; a head speed is remarkably lower as compared with a normal shot (a driver shot or an iron shot). In the case in which the head speed is low, an amount of crush of the ball which is caused by the impact is small. In the case in which the head speed is low, a pressure acting between the ball and the face surface is low in the impact so that the contact area of the ball and the face surface is small. In the case in which the head speed is low, moreover, a short time is required for the contact of the ball and the face surface. Consequently, it can be supposed that an interlocking property of the rotation of the head with that of the ball is low in the impact caused by the putting. The gear effect is a phenomenon in which the rotation of the head and that of the ball are interlocked with each other as in gears to be engaged with each other. In the impact caused by the putting, it can be supposed that the gear effect is small due to the low interlocking property. As a result, it can be supposed that the effect of controlling the backspin rate which is obtained by the effective loft angle is greater than the effect of increasing the backspin rate which is obtained by the gear effect.

A material of the head 4 is not particularly restricted but examples thereof include a metal, a resin and the like. Examples of the metal include stainless, soft iron (mild steel), a titanium alloy, an aluminum alloy and the like. Examples of the resin include an epoxy resin, a polycarbonate resin and the like. The resin may be CFRP (carbon fiber reinforced plastic). In order to increase a moment of inertia, to change a position of a center of gravity and to enhance a feeling of hitting, the head 4 may be constituted by a plurality of materials. It is also possible to employ the head 4 in which a head body and a separate member are combined with each other. Examples of the separate member include the rear member 14. Examples of a metal constituting a material of the separate member include tungsten, brass, copper, zinc and their alloys. Examples of a material of another separate member include an urethane resin, CFRP and the like.

A volume V of the head 4 is not particularly restricted but is usually set to be 30 cc to 150 cc. A weight of the head 4 is not particularly restricted but is set to be approximately 250 g to 500 g in consideration of a swing balance of a club. It is preferable that a length of the putter club 2 should be set into a range within the rules of the golf club.

EXAMPLES

Although the effects of the present invention will be apparent from examples, the present invention should not be construed to be restrictive based on description of the examples.

Example 1

A face insert and a rear member were bonded to a head body formed of a 6061 aluminum alloy so that the head shown in FIGS. 2 to 6 was obtained. A material of the face insert was set to be polyurethane. A material of the rear member was set to be a tungsten alloy. By combining a shaft and a grip with the head, the golf putter shown in FIG. 1 was obtained. A specification and an evaluation result according to the example 1 are shown in the following Table 1.

Examples 2 to 10 and Comparative Examples 1 to 4

In order to obtain the specification shown in the Table 1, a head and a golf club according to each of examples were obtained in the same manner as in the example 1 except that at least one of the following (a) to (g) was changed.

(a) A length in the front-rear direction of a forward inclined surface, (b) An inclination angle of the forward inclined surface, (c) A length in the front-rear direction of a rearward inclined surface, (d) An inclination angle of the rearward inclined surface, (e) Presence of the rearward inclined surface, (f) A weight or size of a rear member, and (g) A position in the up-down direction of the rear member.

The specification and evaluation result in each of the examples is shown in the following Table 1.

[Evaluating Method 1: Variation in Rolling Distance]

Ten golf players carry out putting by aiming at a target point placed apart by four meters over a green. Each of the golf players carries out the putting in order to stop a ball on the target point. Each of the golf players first hits the ball ten times for practice and further hits the ball ten times after the practice. A measurement is carried out for the ten times after the practice. A line S connecting a position of the ball in the hitting and the target point is set to be a target direction. Referring to each of the hit balls, a distance in the target direction between a stop point of the ball and the target point is measured. In both the case in which the ball stops beyond the target point and the case in which the ball stops before the target point, a measured value is set to be a plus (positive) value. Average values corresponding to the ten times are calculated, and furthermore, a final average value is calculated by averaging the average values for the ten golf players. The final average value is changed into an index with a value in the example 3 set to be 100. The index is shown in the following Table 1. When the index is increased, a variation in a rolling distance is made greater. When the index is reduced, the rolling distance is made stabler and more excellent.

[Evaluating Method 2: Variation in Directivity]

A test for the "Variation in Rolling Distance" is also utilized for an evaluation of "Variation in Directivity". As described above, a distance (the shortest distance) between a stop point of a ball and the line S is measured for each of the balls hit as described above. Even if the ball turns away in a rightward or leftward direction, a measured value of the distance is set to be a plus (positive) value. Average values corresponding to the ten times are calculated, and furthermore, a final average value is calculated by averaging the average values for ten golf players. The final average value is changed into an index with a value in the example 3 set to be 100. The index is shown in the following Table 1. When the index is increased, a variation in a directivity is made greater. When the index is reduced, the directivity is made stabler and more excellent.

TABLE 1

Specification and Evaluation Result in Example and Comparative Example

| | Comparative Example 1 | Example 1 | Example 2 | Example 3 | Comparative Example 2 | Example 4 | Example 5 | Example 6 | Example 7 | Example 8 | Comparative Example 3 | Example 9 | Example 10 | Comparative Example 4 |
|---|---|---|---|---|---|---|---|---|---|---|---|---|---|---|
| P (mm) | 80 | 80 | 80 | 80 | 80 | 80 | 80 | 80 | 80 | 80 | 80 | 80 | 80 | 80 |
| M (mm) | 35 | 35 | 35 | 35 | 35 | 35 | 35 | 35 | 35 | 35 | 35 | 35 | 35 | 35 |
| Q (mm) | 30 | 30 | 30 | 30 | 30 | 5 | 10 | 20 | 40 | 45 | 30 | 30 | 30 | 30 |
| L (mm) | 5 | 10 | 20 | 30 | 35 | 30 | 30 | 30 | 30 | 30 | 30 | 30 | 30 | 30 |
| N (mm) | 23 | 23 | 23 | 23 | 23 | 23 | 23 | 23 | 23 | 23 | 23 | 23 | 23 | 23 |
| K1 (mm) | 0.45 | 0.75 | 0.90 | 0.45 | 0.00 | 0.45 | 0.45 | 0.45 | 0.45 | 0.45 | 0.07 | 0.22 | 0.74 | 1.11 |
| K1/M | 0.01 | 0.02 | 0.03 | 0.01 | 0.00 | 0.01 | 0.01 | 0.01 | 0.01 | 0.01 | 0.00 | 0.01 | 0.02 | 0.03 |
| L/P | 0.06 | 0.13 | 0.25 | 0.38 | 0.44 | 0.38 | 0.38 | 0.38 | 0.38 | 0.38 | 0.38 | 0.38 | 0.38 | 0.38 |
| Q/P | 0.38 | 0.38 | 0.38 | 0.38 | 0.38 | 0.06 | 0.13 | 0.25 | 0.50 | 0.56 | 0.38 | 0.38 | 0.38 | 0.38 |
| Real Loft Angle (degree) | 2 | 2 | 2 | 2 | 2 | 2 | 2 | 2 | 2 | 2 | 2 | 2 | 2 | 2 |
| Angle θ1 (degree) | 6 | 6 | 6 | 6 | 6 | 6 | 6 | 6 | 6 | 6 | 1 | 3 | 10 | 15 |
| Variation in Directivity | 101 | 105 | 98 | 100 | 113 | 123 | 109 | 99 | 100 | 102 | 119 | 103 | 101 | 105 |
| Variation in Rolling Distance | 159 | 139 | 114 | 100 | 145 | 138 | 117 | 102 | 103 | 106 | 152 | 129 | 118 | 149 |

As shown in the Table 1, a higher evaluation is obtained in each of the examples as compared with the comparative examples. From the results of the evaluation, the advantage of the present invention is apparent.

The above description is only illustrative and various changes can be made without departing from the scope of the present invention.

The present invention can be applied to every golf putter.

What is claimed is:

1. A golf putter comprising a head, a shaft and a grip, wherein a real loft angle is equal to or greater than one degree and is equal to or smaller than four degrees, a length P (mm) in the front-rear direction of the head is equal to or greater than 30 mm and is equal to or smaller than 100 mm, a state in which the head is stationarily mounted by itself on a horizontal plane H1 is set to be a reference state, a plane which passes through a center of gravity of the head, is perpendicular to the horizontal plane H1 and includes a line in the front-rear direction is set to be a reference plane in the head brought into the reference state, and a section of the head in the reference state along the reference plane is set to be a reference section, and when an intersection point of a line which passes through the center of gravity of the head and is perpendicular to the horizontal plane H1 and a sole surface is represented by T1, a line passing through the point T1 and a leading edge point is represented by S1, a point which is present on the sole surface and is provided apart from the line S1 toward a lowermost side is represented by T2, a line which passes through the point T2 and is parallel with the line S1 is represented by S2, a distance between the point T2 and the line S1 is represented by K1 (mm), a line passing through the point T2 and the leading edge point is represented by S3, a distance in the front-rear direction between the point T2 and the leading edge point is represented by L (mm), and a distance in the front-rear direction between the point T1 and the leading edge point is represented by M (mm) in the reference section, an angle θ1 formed by the line S3 and the horizontal plane H1 is equal to or greater than two degrees and is equal to or smaller than ten degrees, (K1/M) is greater than zero and is equal to or smaller than 0.10, (L/P) is equal to or greater than 0.10 and is equal to or smaller than 0.50, and a lower portion is positioned below the line S1 between the point T1 and the leading edge point.

2. The golf putter according to claim 1, wherein a height N of the center of gravity of the head is equal to or greater than 20 mm.

3. The golf putter according to claim 2, wherein the sole surface has a plane portion including the point T1, and when a rearmost point of the plane portion is represented by T3 and a distance in the front-rear direction between the point T1 and the point T3 is presented by Q (mm) in the reference section, (Q/P) is equal to or greater than 0.1.

4. The golf putter according to claim 1, wherein the sole surface has a plane portion including the point T1, and when a rearmost point of the plane portion is represented by T3 and a distance in the front-rear direction between the point T1 and the point T3 is presented by Q (mm) in the reference section, (Q/P) is equal to or greater than 0.1.

* * * * *

UNITED STATES PATENT AND TRADEMARK OFFICE

CERTIFICATE OF CORRECTION

PATENT NO. : 7,625,299 B2
APPLICATION NO. : 12/230610
DATED : December 1, 2009
INVENTOR(S) : Hiroaki Fujimoto It is certified that error appears in the above-identified patent and that said Letters Patent is hereby corrected as shown below:

In the Specification:

At column 3, line 7, please change "one of ends of" to --one end of--;

line 8, please change "close portion" to --portion close--.

At column 4, line 5, change "centre" to --center--.

Signed and Sealed this

Twenty-first Day of December, 2010

David J. Kappos

David J. Kappos
*Director of the United States Patent and Trademark Office*